US009518381B2

(12) United States Patent
Whitehead et al.

(10) Patent No.: US 9,518,381 B2
(45) Date of Patent: Dec. 13, 2016

(54) PLUMBING OUTLET BOX WITH MOUNTING FEATURES

(71) Applicant: IPS Corporation, Collierville, TN (US)

(72) Inventors: James H. Whitehead, Collierville, TN (US); Jeffrey A. Humber, Memphis, TN (US)

(73) Assignee: IPS Corporation, Collierville, TN (US)

( * ) Notice: Subject to any disclaimer, the term of this patent is extended or adjusted under 35 U.S.C. 154(b) by 0 days.

(21) Appl. No.: 14/682,645

(22) Filed: Apr. 9, 2015

(65) Prior Publication Data

US 2015/0225930 A1 Aug. 13, 2015

Related U.S. Application Data

(63) Continuation-in-part of application No. 14/536,222, filed on Nov. 7, 2014, which is a continuation-in-part of application No. 14/154,949, filed on Jan. 14, 2014.

(51) Int. Cl.
*E03C 1/02* (2006.01)
*D06F 39/08* (2006.01)

(52) U.S. Cl.
CPC ..... *E03C 1/021* (2013.01); *D06F 39/08* (2013.01); *Y10T 137/698* (2015.04)

(58) Field of Classification Search
CPC ..... E03C 1/021; Y10T 137/698; D06F 39/08
USPC 137/360, 361; 312/242, 229; 4/695; 248/57, 56; 52/34, 35; 220/3.3–3.6
See application file for complete search history.

(56) References Cited

U.S. PATENT DOCUMENTS

| | | | | |
|---|---|---|---|---|
| 1,156,885 | A | 10/1915 | Caine | |
| 3,096,782 | A | 7/1963 | Williams | |
| 3,834,781 | A | 9/1974 | Logsdon | |
| 3,847,175 | A | 11/1974 | Anderson | |
| 3,996,959 | A | 12/1976 | Caruth | |
| 4,135,337 | A | 1/1979 | Medlin | |
| 4,165,443 | A * | 8/1979 | Figart | H02G 3/16 174/53 |
| 4,165,851 | A | 8/1979 | Bowden, Jr. et al. | |
| 4,410,004 | A * | 10/1983 | Kifer | D06F 39/08 137/360 |
| 4,564,249 | A | 1/1986 | Logsdon | |
| 4,637,422 | A | 1/1987 | Izzi, Sr. | |
| 4,716,925 | A | 1/1988 | Prather | |
| 4,865,072 | A | 9/1989 | Logsdon | |
| 4,934,410 | A | 6/1990 | Humber | |
| 4,942,896 | A | 7/1990 | Slusser | |
| 5,025,944 | A | 6/1991 | Rodick | |

(Continued)

OTHER PUBLICATIONS

Office Action for corresponding Canadian Application No. 2,877,399 dated Dec. 2, 2015.

(Continued)

*Primary Examiner* — Craig Schneider
*Assistant Examiner* — Josephine Trinidad-Borges
(74) *Attorney, Agent, or Firm* — Alston & Bird LLP

(57) ABSTRACT

Plumbing outlet boxes, such as for connecting washing machines, ice makers, and other plumbed appliances to plumbing systems, are provided that can be attached to each other in an assembly via a bracket. The plumbing outlet boxes may include one or more connectors. The assembly may further include a bracket having a plurality of engaging portions for engaging the connectors of the plumbing outlet boxes. The bracket may engage the plumbing outlet boxes to each other and/or to a stud within a wall.

14 Claims, 9 Drawing Sheets

(56) References Cited

U.S. PATENT DOCUMENTS

| | | | | |
|---|---|---|---|---|
| 5,050,632 | A | 9/1991 | Means, Jr. | |
| 5,261,444 | A | 11/1993 | Childers | |
| 5,538,033 | A | 7/1996 | Condon | |
| 5,696,350 | A | 12/1997 | Anker | |
| 5,755,247 | A | 5/1998 | Condon | |
| 5,983,923 | A | 11/1999 | Hobbs et al. | |
| 6,101,780 | A * | 8/2000 | Kreidt | E04B 1/2608 52/281 |
| 6,125,881 | A | 10/2000 | Hobbs et al. | |
| 6,129,109 | A | 10/2000 | Humber | |
| 6,148,850 | A | 11/2000 | Kopp et al. | |
| 6,155,286 | A | 12/2000 | Geary | |
| 6,234,193 | B1 | 5/2001 | Hobbs | |
| 6,435,206 | B1 | 8/2002 | Minnick | |
| 6,845,785 | B1 | 1/2005 | Condon | |
| 7,357,148 | B1 * | 4/2008 | Gibson | E03C 1/021 137/360 |
| 7,360,553 | B1 | 4/2008 | Ismert | |
| 7,370,663 | B2 | 5/2008 | Lundeberg et al. | |
| 7,614,419 | B2 | 11/2009 | Minnick | |
| 7,735,511 | B1 | 6/2010 | Ismert | |
| 8,020,581 | B1 | 9/2011 | Julian et al. | |
| 9,394,674 | B2 | 7/2016 | Whitehead et al. | |
| 2005/0251908 | A1 * | 11/2005 | Doverspike | E03C 1/042 4/695 |
| 2010/0000614 | A1 | 1/2010 | Zahuranec et al. | |
| 2014/0352798 | A1 | 12/2014 | Clarke et al. | |

OTHER PUBLICATIONS

Office Action for corresponding U.S. Appl. No. 14/154,949 dated Dec. 17, 2015.

Office Action for corresponding U.S. Appl. No. 14/536,222 dated Dec. 16, 2015.

Patent Examination Report No. 1 from corresponding Australian Patent Application No. 2015200130 dated Oct. 1, 2015.

Halo Recessed Lighting—Product Catalog [online] [retreived Dec. 10, 2015]. Retrieved from the Internet: <URL: http://www.cooperindustries.com/content/dam/public/lighting/resources/library/literature/Halo/ADV100800-Halo%20Recessed%20Catalog.pdf>. 308 pages.

Sioux Chef OxBox Washing Machine Outlet Box [online] [retrieved Nov. 15, 2013]. Retrieved from the Internet: <URL: http://www.siouxchief.com/products/supply/access/laundry-boxes/oxbox-washing-machine-outlet-box>. 3 pages.

IPS Water Tite—Dual Drain Washing Machine Outlet Boxes [online] [retrieved Jul. 11, 2014]. Retrieved from the Internet: <URL: https://web.archive.org/web/20040820021208/http://www.ipscorp.com . . . >. 3 pages.

IPS Water Tite—Angle Stop Boxes [online] [retrieved Jul. 11, 2014]. Retrieved from the Internet: <URL: https://web.archive.org/web/20040814035049/http://www.ipscorp.com . . . >. 2 pages.

Notice of Allowance for U.S. Appl. No. 14/154,949 dated Mar. 11, 2016.

Notice of Allowance for U.S. Appl. No. 14/536,222 dated Mar. 18, 2016.

Notice of Allowance for Canadian Application No. 2,892,865 dated Mar. 10, 2016.

First Examination Report for corresponding New Zealand Patent Application No. 716881, dated Apr. 20, 2016.

Patent Examination Report No. 1 from corresponding Australian Patent Application No. 2015202798 dated Apr. 15, 2016.

Notice of Allowance for corresponding U.S. Appl. No. 14/154,949 dated Apr. 22, 2016.

Notice of Allowance for corresponding U.S. Appl. No. 14/536,222 dated Apr. 22, 2016.

Patent Examination Report No. 1 from corresponding Australian Patent Application No. 2016201266, dated Jul. 5, 2016, 3 pages.

Office Action for corresponding U.S. Appl. No. 15/182,232, dated Sep. 14, 2016, 20 pages.

Office Action for corresponding U.S. Appl. No. 15/185,595, dated Sep. 16, 2016, 20 pages.

* cited by examiner

PLUMBING OUTLET BOX WITH MOUNTING FEATURES

CROSS-REFERENCE TO RELATED APPLICATIONS

This application is a continuation-in-part of U.S. patent application Ser. No. 14/536,222, entitled "Plumbing Outlet Box with Integrated Mounting Features" and filed Nov. 7, 2014, which application is a continuation-in-part of U.S. patent application Ser. No. 14/154,949, entitled "Plumbing Outlet Box With Integrated Mounting Features" and filed Jan. 14, 2014, each of which is hereby incorporated by reference herein in its entirety.

FIELD OF THE INVENTION

The present invention relates generally to plumbing outlet boxes, such as outlet boxes for connecting washers, ice makers, and other equipment to plumbing systems.

BACKGROUND

Conventional plumbing outlet boxes are typically used as housings for connections to plumbing systems. A plumbing outlet box may be provided, for example, for connecting a washing machine to pipes running within the walls of a building that are designed to carry water (e.g., hot and cold water supply and drain connections). As another example, a plumbing outlet box may be provided to connect an ice maker of a refrigerator to a water supply. Plumbing outlet boxes are generally installed in the walls of a house or other climate-controlled building. Often more than one plumbing outlet box is needed in the same area, each with the capability of connecting to different appliances having different configurations and requirements.

Accordingly, there is a need in the art for plumbing outlet boxes and related attachment devices that can be configured to accommodate different types of connections and are easy to install, separately and in combination with other plumbing outlet boxes.

BRIEF SUMMARY OF EXAMPLE EMBODIMENTS

An assembly of plumbing outlet boxes, such as for connecting washing machines, ice makers, and other plumbed appliances to plumbing systems, are therefore provided that can be attached to one another. In some embodiments at least a first plumbing outlet box and a second plumbing outlet box may each be configured for mounting within a wall. Each plumbing outlet box may include a housing including a top wall, a bottom wall, first and second side walls, and an opening providing access into an interior of the housing. A first connector may be disposed on the top wall. A second connector may be disposed on the bottom wall. In some embodiments, the plumbing outlet box assembly may include a bracket defining a plurality of engaging portions. In some embodiments, the second plumbing outlet box housing may be configured to be engaged with the first plumbing outlet box housing via engagement of a first engaging portion of the bracket with the first connector of the first plumbing outlet box and via engagement of a second engaging portion of the bracket with the second connector of the second plumbing outlet box, such that the first plumbing outlet box may be engaged with the second plumbing outlet box via the bracket.

In some embodiments, the bracket may be further configured to engage the second connector of the first plumbing outlet box and the first connector of the second plumbing outlet box. The bracket may be configured to engage a stud such that the bracket may be configured to attach the first plumbing outlet box and the second plumbing outlet box to the stud. In some embodiments, the bracket may further include a built-in fastening feature, such that the bracket may be configured to engage the stud with the built-in fastening feature.

In some embodiments, at least one of the first connector and the second connector may define a receiving channel configured to receive a corresponding one of the first engaging portion or the second engaging portion of the bracket. The at least one of the first connector and the second connector may define a plurality of offset tabs defining the receiving channel therebetween.

The bracket may define a projection on the corresponding one of the first engaging portion or the second engaging portion configured to engage the at least one of the first connector and the second connector.

In some embodiments, at least one of the first plumbing outlet box and the second plumbing outlet box may define one or more mounting tabs configured to engage the at least one of the first plumbing outlet box and the second plumbing outlet box to a stud.

In another embodiment, a plumbing outlet box may be provided that may be configured for mounting within a wall. The plumbing outlet box may include a housing including a top wall, a bottom wall, a first side wall, and a second side wall. The plumbing outlet box may further include an opening providing access into an interior of the housing. In some embodiments, the plumbing outlet box may include a first connector disposed on the top wall. The plumbing outlet box may additionally or alternatively include a second connector disposed on the bottom wall. The first connector may be configured to engage a bracket via a first engaging portion of the bracket and the second connector may be configured to engage the bracket via a second engaging portion of the bracket. The plumbing outlet box may be configured to engage a second plumbing outlet box via the bracket.

The plumbing outlet box may be configured to be at least partially supported by the connectors such that the bracket may be configured to engage a stud to attach the plumbing outlet box to the stud. In some embodiments, at least one of the first connector and the second connector may define a receiving channel configured to receive a corresponding one of the first engaging portion or the second engaging portion of the bracket. The at least one of the first connector and the second connector may define a plurality of offset tabs defining the receiving channel therebetween. The at least one of the first connector and the second connector may be configured to engage a projection of the bracket.

In some embodiments, the plumbing outlet box may include one or more mounting tabs configured to engage a stud.

Yet another example embodiment may include a bracket for mounting a plumbing outlet box within a wall. In some embodiments, the bracket may include a plurality of engaging portions. A first engaging portion may be disposed proximate a first end of the bracket. A second engaging portion may be disposed proximate a second end of the bracket. In some embodiments, the bracket may be configured to engage a first connector of a first plumbing outlet box with the first engaging portion. The bracket may be configured to engage a second connector of a second plumbing outlet box with the second engaging portion, such that the bracket may be configured to engage the first plumbing outlet box with the second plumbing outlet box.

In some embodiments, the bracket may be configured to engage a stud such that the bracket may be configured to attach the first plumbing outlet box and the second plumbing outlet box to the stud. The bracket may further include a built-in fastening feature, such that the bracket may be configured to engage the stud with the built-in fastening feature. The built-in fastening feature may include a pointed fastening feature integrally formed with the bracket.

In some embodiments, the bracket may define a projection on at least one of the first engaging portion or the second engaging portion configured to engage the at least one of the first connector and the second connector.

The bracket may include a third engaging portion disposed proximate one of the first end or the second end of the bracket. The third engaging portion may be configured to engage a third connector of the first plumbing outlet box via the third engaging portion.

BRIEF DESCRIPTION OF THE DRAWINGS

Figure 1:
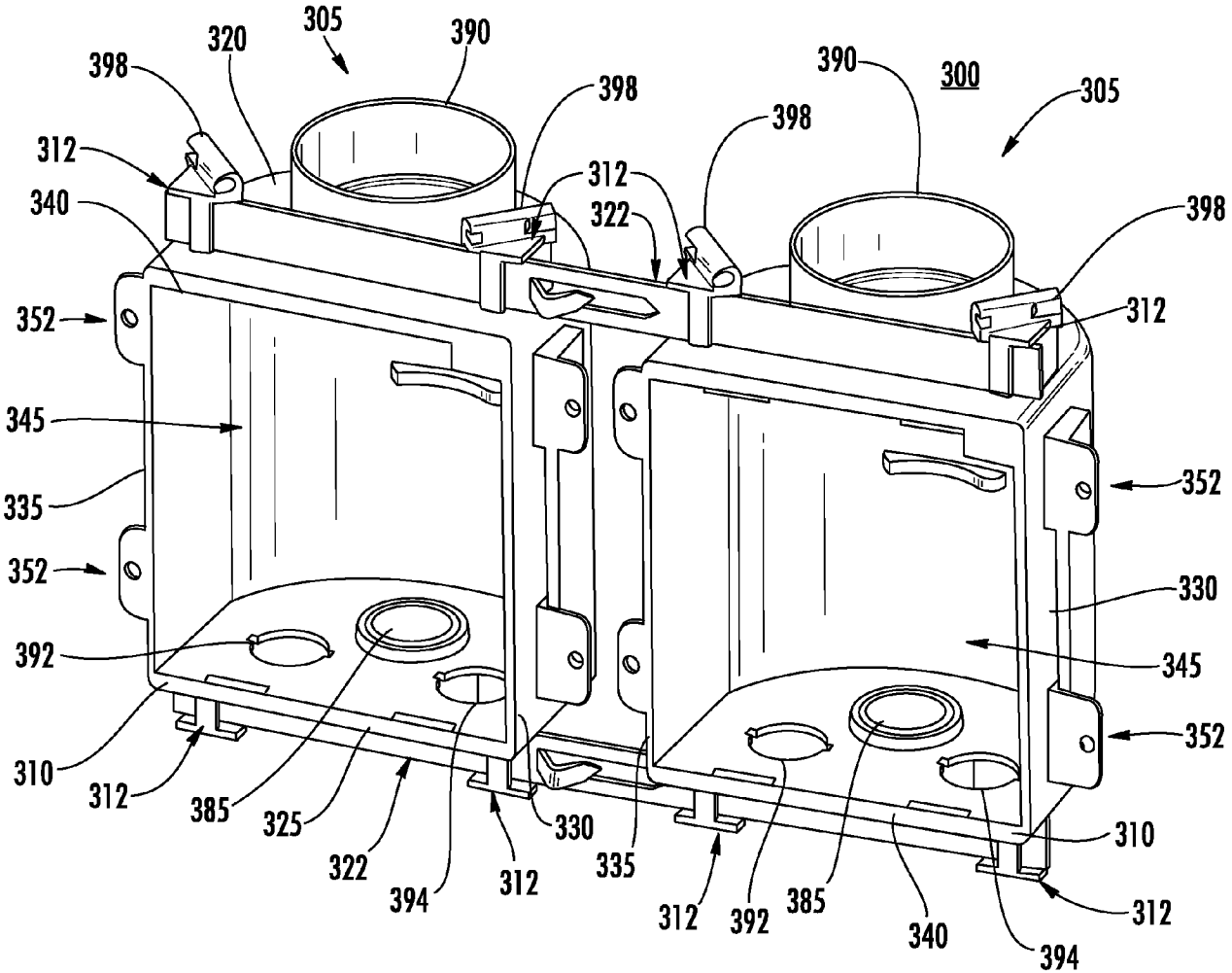
Figure 2:
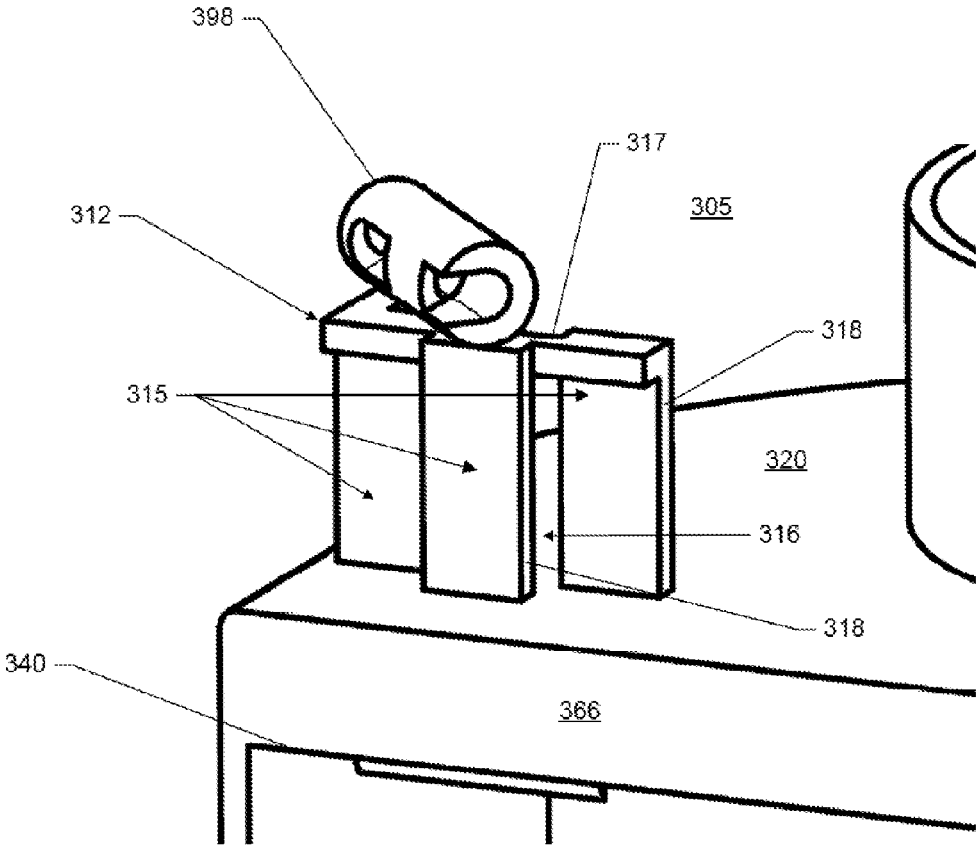
Figure 3:
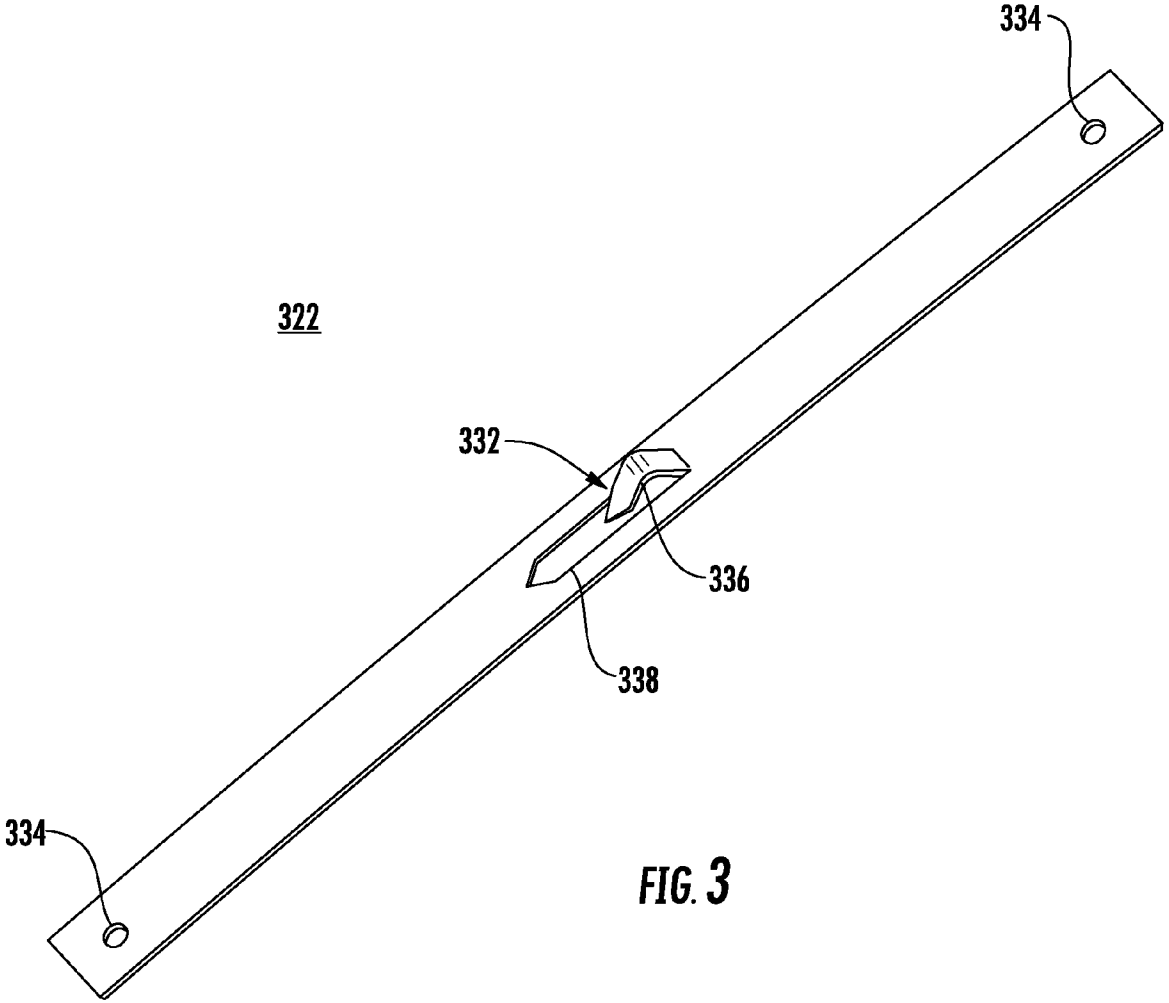
Figure 4:
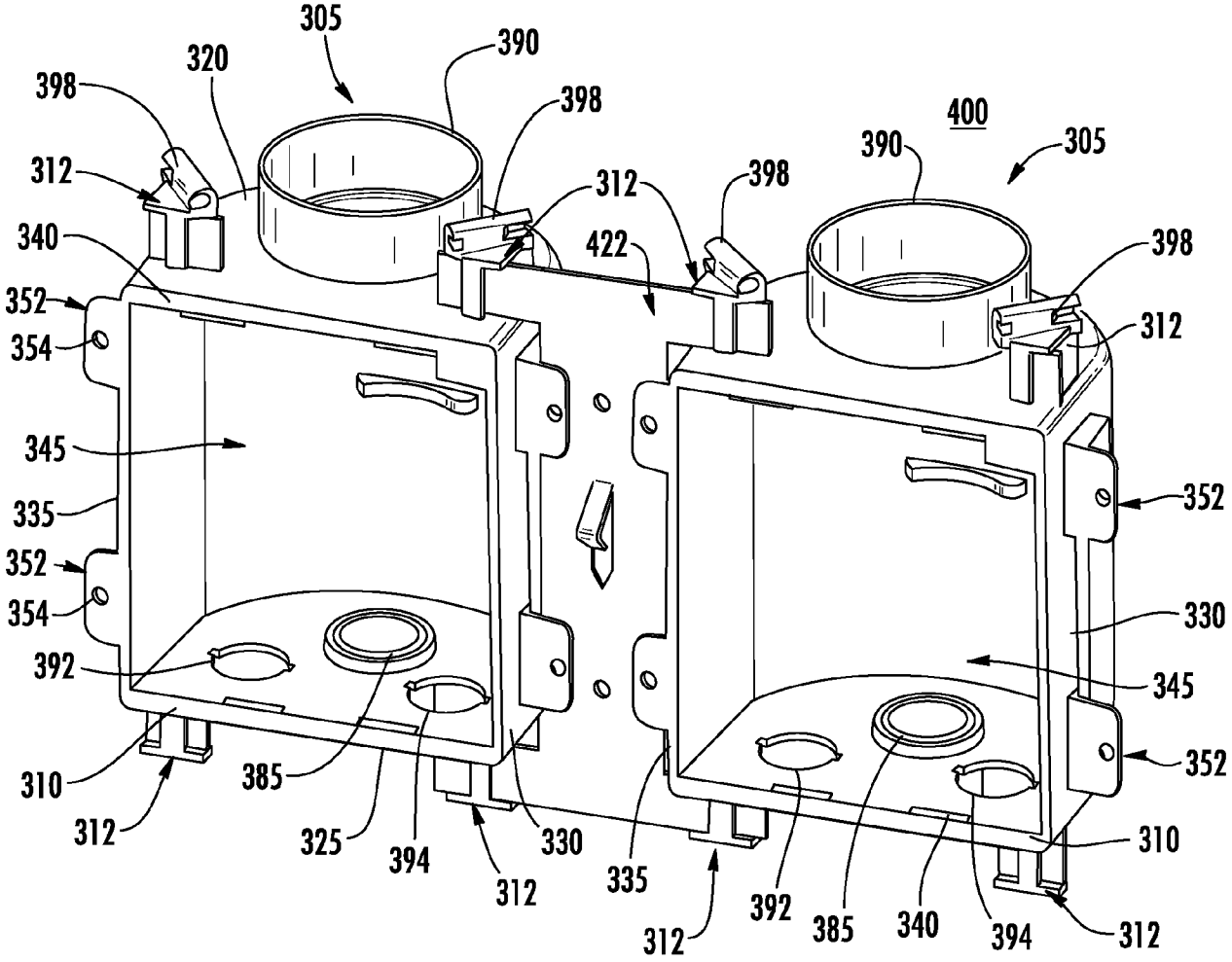
Figure 5:
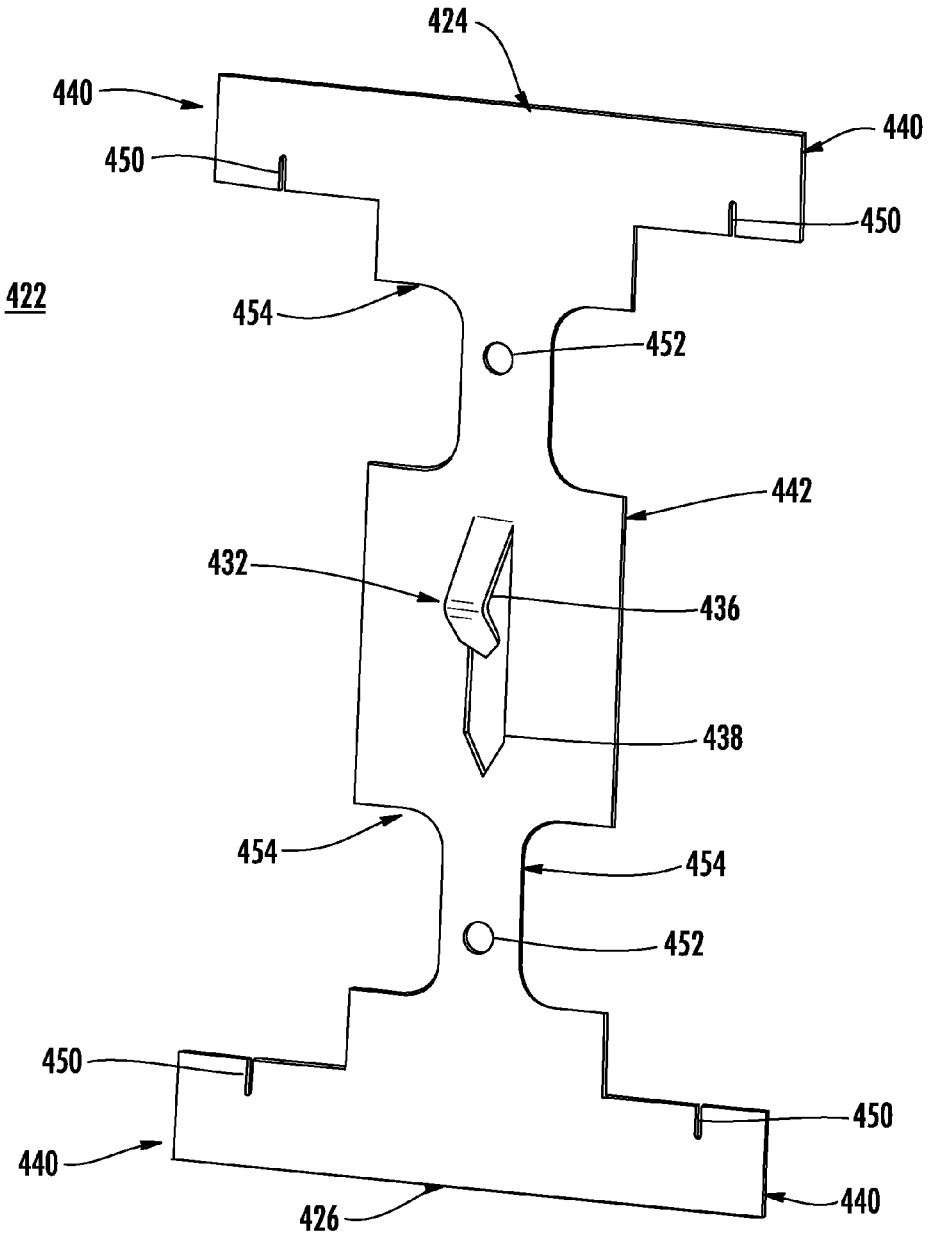
Figure 6:
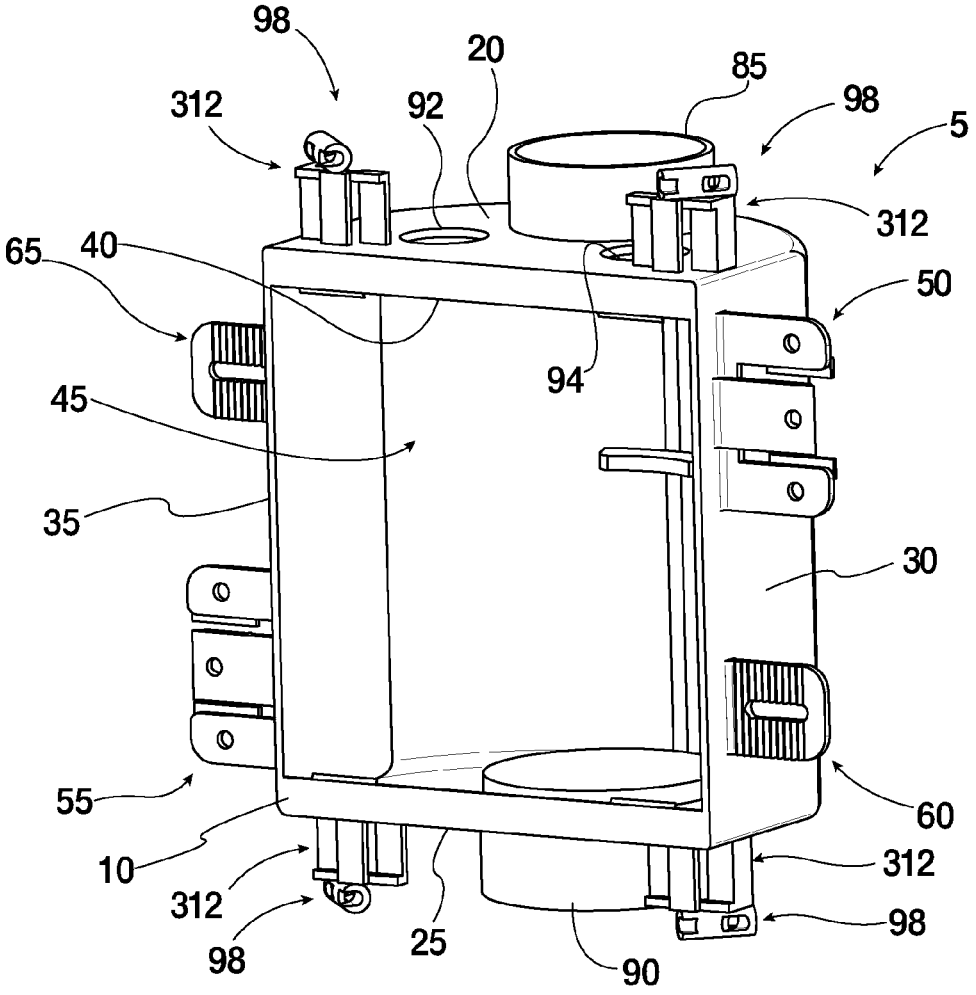
Figure 7:
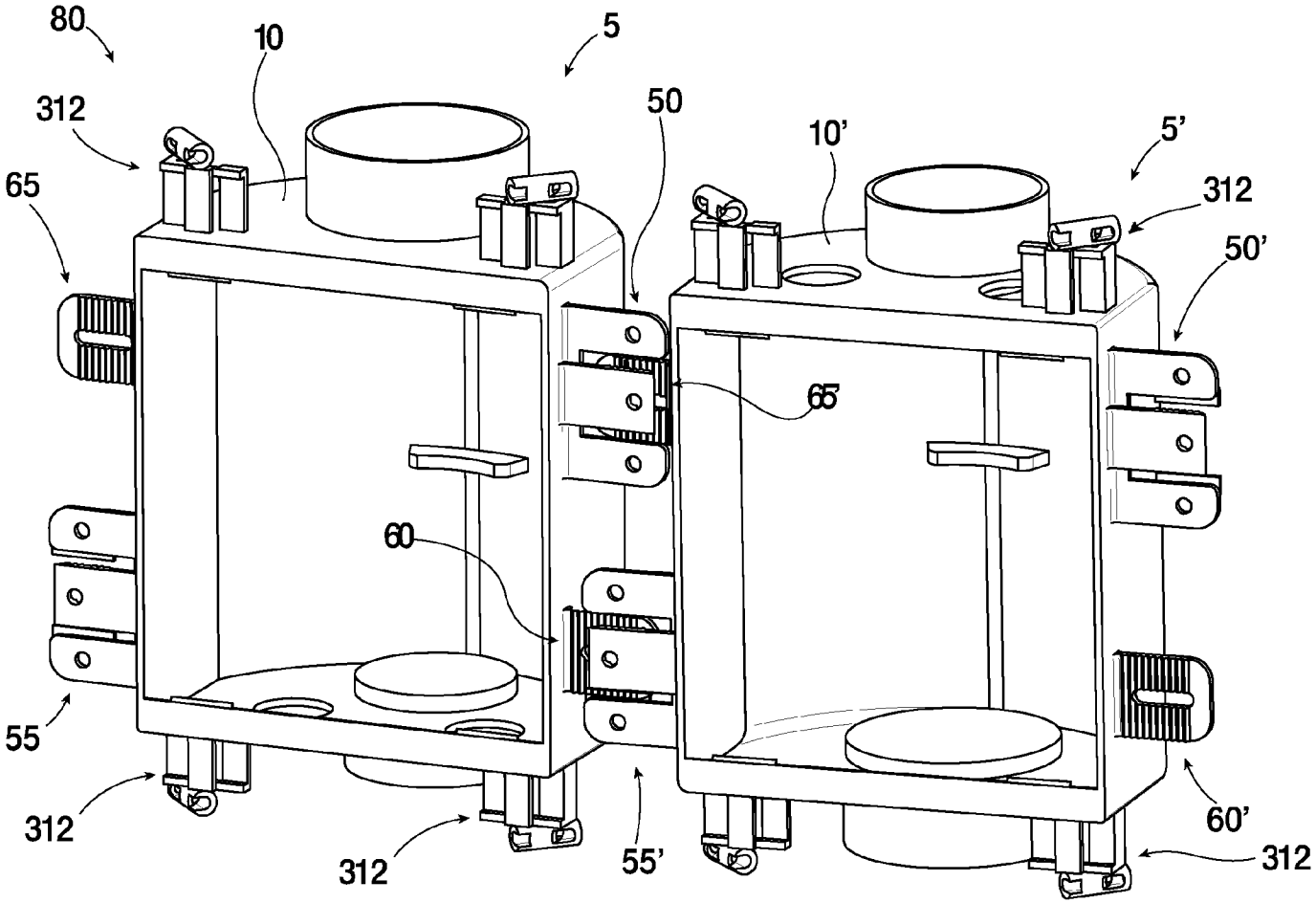
Figure 8:
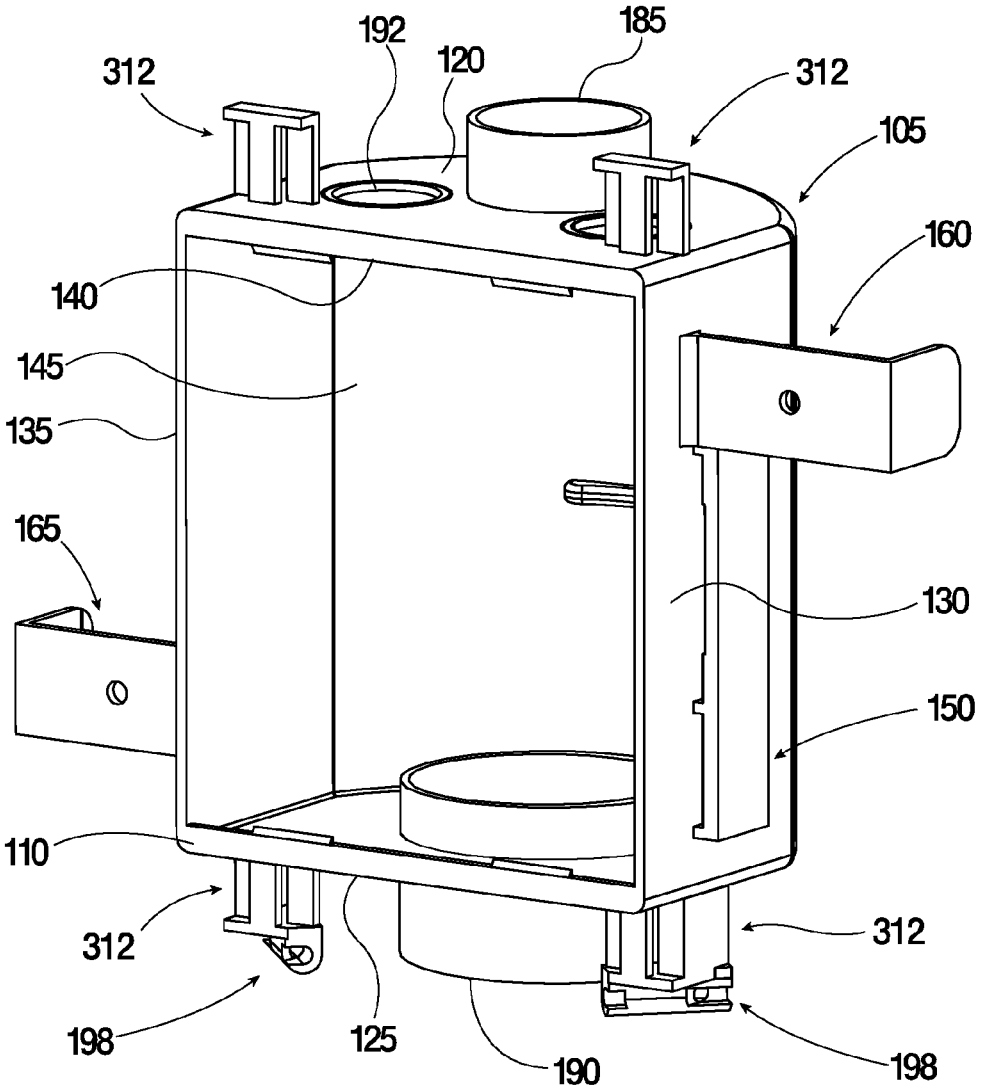
Figure 9:
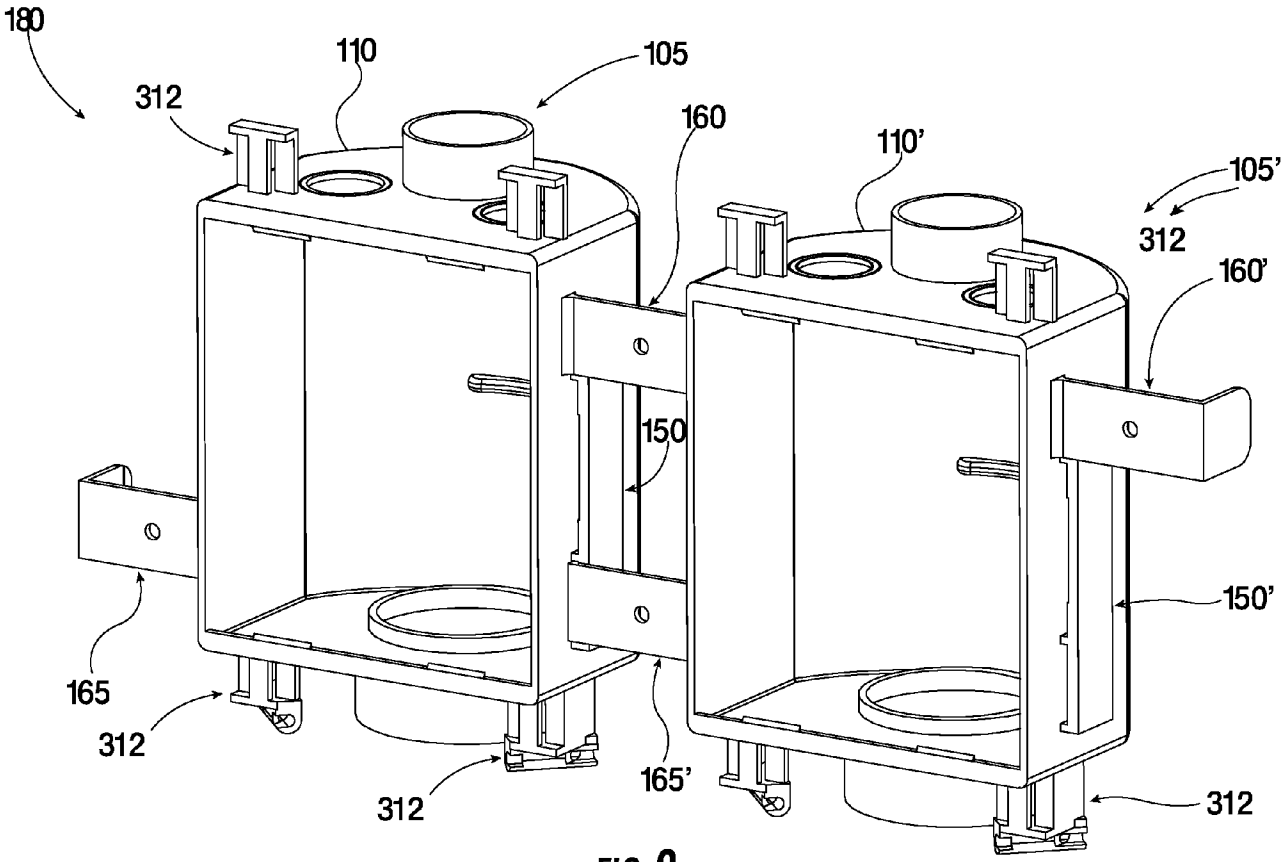

Having thus described the invention in general terms, reference will now be made to the accompanying drawings, which are not necessarily drawn to scale, and wherein:

FIG. 1 shows a perspective view of an assembly of plumbing outlet boxes in accordance with an example embodiment of the present invention;

FIG. 2 shows a partial view of a plumbing outlet box showing a connector in accordance with an example embodiment of the present invention;

FIG. 3 shows a bracket in accordance with an example embodiment of the present invention;

FIG. 4 shows a perspective view of an assembly of plumbing outlet boxes in accordance with another example embodiment of the present invention;

FIG. 5 shows a bracket in accordance with another example embodiment of the present invention;

FIG. 6 shows a perspective view of a housing of a plumbing outlet box in accordance with another example embodiment of the present invention;

FIG. 7 shows a perspective view of an assembly of plumbing outlet boxes in accordance with another example embodiment of the present invention;

FIG. 8 shows a perspective view of a housing of a plumbing outlet box in accordance with another example embodiment of the present invention; and FIG. 9 shows a perspective view of an assembly of plumbing outlet boxes in accordance with another example embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Some components of the plumbing outlet box and associated systems are not shown in one or more of the figures for clarity and to facilitate explanation of embodiments of the present invention.

As used herein, the terms "bottom," "top," "upper," "lower," "interior," "exterior," and similar terms are used for ease of explanation and refer generally to the position of certain components of embodiments of the described invention in the installed configuration (e.g., in an operational configuration). It is understood that such terms are not used in any absolute sense, and, as such, a component described as a "bottom wall" may be on the same level (e.g., at the same distance from the ground) as another component described as a "side wall" in certain configurations of embodiments of the described invention, such as when the plumbing outlet boxes are laying on a flat surface prior to installation as opposed to held within a wall, as described below. Moreover, in some embodiments, the plumbing outlet boxes described herein may be configured to be installed in more than one orientation to accommodate different types of connections. For example, in one installation scenario, one end of the plumbing outlet box may be disposed such that it forms an "upper" or "top" wall of the housing (closer to the ceiling), whereas in another installation scenario that same end of the plumbing outlet box may be disposed such that it forms a "lower" or "bottom" wall of the housing (closer to the floor).

Moreover, although the examples used below refer primarily to plumbing outlet boxes for providing washing machines with access to a hot and cold water supply and/or to a drain, embodiments of the present invention may further be applicable to plumbing outlet boxes for other applications and in other contexts (e.g., for an ice maker, dishwasher, sink and toilet angle stop, etc.), as noted above.

Plumbing outlet boxes are typically installed within a wall of the building, such as a house, apartment building, office building, or other residence or dwelling, in a manner such that the box is accessible to a resident or caretaker (e.g., a plumber) when necessary (e.g., for installation, maintenance, or trouble shooting) and at the same time is not obtrusive to the resident's every day activities. In this regard, a hole is typically cut into the sheet rock of the building wall that is sized to provide access to the plumbing outlet box, and the box is installed within the appropriately sized hole. A faceplate may be applied to the front face of the plumbing outlet box to improve the aesthetics of the plumbing outlet box (e.g., by providing a finished look and hiding the internal components of the box).

The housing of a conventional plumbing outlet box is generally configured to hold certain supply connections (plumbing shut-offs, valves, pipes, and/or fittings). As noted above, depending on the particular purpose of the plumbing outlet box (e.g., for connecting hot and cold water and a drain to a washing machine versus providing water for an ice maker), the type and/or number of connections that must be accommodated by the plumbing outlet box can vary. For example, in one scenario, such as when the plumbing outlet box is used for a washing machine installation, the plumbing outlet box may need to be configured to connect to a hot water source, a cold water source, and a drain. Moreover, depending on the available connections, the hot and cold water sources may be disposed such that the connections must be made via a bottom wall of the housing next to a drain connection in one case, whereas in another case the hot and cold water connections must be made via a top wall of the housing, opposite the drain connection.

As another example, in a scenario in which the plumbing outlet box is used for an ice maker installation, the plumbing outlet box may require only a single opening for connecting to a source of water, such as via the bottom wall of the housing. In still other cases, multiple plumbing outlet boxes may be required. In such cases, for example, two plumbing outlet boxes may need to be positioned next to each other, such as on opposite sides of a stud in the wall.

Thus, in conventional installations, differently configured plumbing outlet boxes (e.g., plumbing outlet boxes having different sizes and/or that include a different number, size, type, and/or location of openings for making certain plumbing connections) may be required depending on the type of installation the plumbing outlet box is to be used for. Providing different options of plumbing outlet boxes may require increased tooling and manufacturing costs, as well as additional costs and headaches related to shipping and inventory. Moreover, installation of the plumbing outlet boxes may be complicated when the correct configuration of plumbing outlet box is not chosen, is not in stock, or is otherwise unavailable.

Accordingly, embodiments of the invention provide a plumbing outlet box that is configured for mounting within a wall and one or more brackets for securing the plumbing outlet box to the wall and/or another plumbing outlet box, where the box has a universal configuration that can accommodate various types of connections for different installation scenarios. In particular, in some embodiments, the plumbing outlet box includes one or more connectors that may engage corresponding structures on the bracket or brackets. The brackets may, either alone or with other fastening devices, engage the plumbing outlet box with another plumbing outlet box. In some embodiments, the brackets may also attach the plumbing outlet box or boxes to a wall or a stud within a wall. As detailed herein, the one or more brackets may maintain one or more of the plumbing outlet boxes in a predetermined orientation within the wall.

With reference to FIG. 1, an example assembly 300 of plumbing outlet boxes is shown. The plumbing outlet boxes 305 may comprise a housing 310 that includes a top wall 320, a bottom wall 325, a first side wall 330, and a second side wall 335. The housing 310 may define an opening 340 that provides access to an interior 345 of the housing. In some embodiments, either or both of the top wall 320 and bottom wall 325 may include one or more connectors 312. Additionally or alternatively, some embodiments of the plumbing outlet box 305 may further include one or more mounting tabs 352 for engaging the wall and/or stud to hold the box in position. In some embodiments, as shown in FIG. 1, the mounting tabs 352 may include one or more holes for inserting a fastener (e.g., a screw, bolt, nail, clip, or the like) to attach the plumbing outlet box 305 to a stud or wall. In other embodiments, as detailed below, the mounting tabs may be configured to engage another plumbing outlet box.

With continued reference to FIG. 1, the plumbing outlet box assembly 300 may be held together, at least in part, by one or more brackets 322. As detailed below, the brackets may be configured to engage the at least one connector 312 of each plumbing outlet box 305 in the assembly 300. The brackets 322 may span the plumbing outlet boxes 305 to hold the boxes in a predetermined orientation. In some embodiments, as shown in FIG. 1, there may be at least two brackets 322 connecting the plumbing outlet boxes 305. In some alternative embodiments, as detailed below, a single bracket may connect the two boxes. In some further embodiments, the brackets 322 may be shorter than the width of the plumbing outlet boxes, such that they engage at least one connector 312.

As detailed below, the brackets 322 and/or the connectors 312 may include one or more projections that hold the brackets in position relative to the plumbing outlet boxes 305. Additionally or alternatively, fasteners (e.g., screws, bolts, nails, clips, or the like) may be used to hold the brackets 322 and boxes 305 together. In some further embodiments, no fasteners may be used and each of the brackets 322 and plumbing outlet boxes 305 may be independently secured to a wall and/or stud, such that the brackets provide rigidity to the structure of the plumbing outlet box assembly 300 while slidably engaging the boxes. In some embodiments, each bracket 322 may engage at least one connector 312 of a plumbing outlet box 305. In some further embodiments, each bracket 322 may engage at least two connectors 312 of a plumbing outlet box 305 to provide further rigidity. In some embodiments, brackets 322 may engage one or more connectors 312 on the same side of the respective plumbing outlet boxes 305. For example, as shown in FIG. 1, each bracket 322 is connected to the connectors 312 on either the respective top walls 320 or the bottom walls 325 of each plumbing outlet box 305. In some alternative embodiments, as detailed below, a bracket may connect to one or more connectors on both the top and bottom walls of the plumbing outlet boxes.

With continued reference to FIG. 1, each plumbing outlet box 305 may include at least two connectors 312 on the top wall 320 and/or bottom wall 325. In such embodiments, the brackets 322 may engage two or more connectors 312 in order to give multiple points of contact with each plumbing outlet box. Such a configuration may reduce torsion on the bracket 322 and/or connectors 312. In the embodiment shown in FIG. 1, each of the top walls 320 and bottom walls 325 of the plumbing outlet boxes 305 includes two connectors 312, with a first bracket 322 spanning the top walls of the plumbing outlet boxes and a second bracket 322 spanning the bottom walls of the plumbing outlet boxes.

In some embodiments, a single plumbing outlet box may be fastened within a wall using the mounting tabs 352 and/or brackets 322. In some alternative embodiments, more than two plumbing outlet boxes may be mounted within a wall using a single set of brackets 322. For example, the brackets 322 may extend to a third plumbing outlet box and connect the third plumbing outlet box as part of the plumbing outlet box assembly. In some embodiments, a bracket may be configured to span multiple studs and support one or more plumbing outlet boxes therebetween. In some alternative embodiments, a bracket may be configured to attach to a single stud and support one or more plumbing outlet boxes on either side of the stud. In yet another embodiment, the bracket may be configured to attach directly to the wall surface (e.g., a drywall surface) to support one or more plumbing outlet boxes. Additionally or alternatively, angled brackets 398 may be disposed on one or more of the connectors 312 for allowing a fastener to further secure the plumbing outlet box 305 to a stud.

Referring back to FIG. 1, the plumbing outlet boxes 305 may have connectors 312 and/or mounting tabs 352 that are rotationally symmetric. Due to the rotational symmetry of the placement of the respective receiving features and mounting tabs, the plumbing outlet box housings 310 may be configured to be engaged to each other regardless of the relative orientation of the two plumbing outlet box housings. In other words, in some embodiments, one or both of the plumbing outlet boxes 305 shown in FIG. 1 may be rotated by 180° from the orientation shown (and/or from the orientation of the other of the two plumbing outlet boxes) while still maintaining the ability to be attached to the bracket and/or wall as described above.

In this regard, in some embodiments, each plumbing outlet box 305 of the assembly 300 may be substantially identical. For the purposes of the description herein, the term "identical" does not preclude the existence of a certain imperfections and differences within an acceptable degree of manufacturing tolerance as understood in the art. Rather, the configuration of each plumbing outlet box 305 may be such that the size, number, position, function, etc. of the connections and openings for making such connections are the same.

Accordingly, a single configuration of a plumbing outlet box (such as the configuration of one of the plumbing outlet boxes 305 shown in FIG. 1, for example) may be used as a "universal" plumbing outlet box, with some or all of the available connections being used as desired to accommodate the particular installation scenario and with the particular orientation of the plumbing outlet box selected to optimize the use of the connections. Referring again to FIG. 1, for example, the plumbing outlet box 305 may be configured such that the top wall 320 and the bottom wall 35 each includes drain openings 385, 390. The bottom drain opening 385 may, for example, have a diameter of 1 inch, whereas the top drain opening 390 may, for example have a diameter of 2 inches. In other embodiments, however, the drain openings 385, 390 may be the same size as each other or different sizes, and the sizes may be larger or smaller than those described herein to accommodate different consumer requirements and usage scenarios. In still other embodiments, at least one of the top wall and the bottom wall may also include a pair of laterally-spaced openings 392, 394 configured to accommodate hot and cold water supply connections, such as to allow the plumbing outlet box 305 to be used in a washing machine installation.

Turning to FIG. 2, a partial view of a plumbing outlet box 305 is shown having a connector 312 disposed on a top wall 320 thereof. In some embodiments, the connector may be offset from the front edge 366 of the plumbing outlet box 305 by approximately the width of a sheet of drywall, or other wall-forming material. In such embodiments, the offset may allow the front edge 366 of the plumbing outlet box 305 to rest flush with the surface of the wall when installed.

In some embodiments, the connectors 312 may be defined as a series of offset tabs 315 configured to define a channel 316 therebetween. The channel 316 may be configured to receive an engaging portion of a bracket 322 (shown in FIG. 1) therein. For example, in the embodiment of FIG. 2, the channel 316 is defined by three vertically oriented, offset tabs 315 connected to the top wall 320 at one end and to a bar 317 at a distal end. The offset tabs 315 may be offset front-to-back (e.g., on an axis connecting the front edge 366 with a back surface) such that the bracket 322 is configured to be disposed therebetween. In some further embodiments, the offset tabs 315 may be offset in a side-to-side direction (e.g., along an axis connecting the first side wall 330 with the second side wall 335 shown in FIG. 1). In some embodiments, the width (e.g., from front to back) of the channel 316 may be narrower than a width of the bracket 322 such that the bracket must curve slightly to engage the connector 312. In such embodiments, the plumbing outlet box 305 may be attached to the bracket 322 via friction.

In some embodiments, the connectors 312 and/or the brackets 322 may include engaging portions defining projections that engage one another to prevent longitudinal motion through the channel 316 once the bracket is engaged with the connector. As detailed below, the projections may be one-way projections that deflect inwardly when a bracket 322 is inserted into the connector 312 but may deflect outwardly and prevent the bracket from being pulled back through the connectors. The projections may engage one or more of the connectors 312. For example, in some embodiments, a projection may only engage one connector 312 with a second connector 312 engaging the bracket via the constraints of the channel 316 only. In some alternative embodiments, the connectors may include buckles, clips, fasteners, or receiving mechanisms therefor that enable a bracket to be engaged with a plumbing outlet box.

Turning to FIG. 3, a bracket 322 is shown in accordance with some embodiments of the present invention. In some embodiments, the bracket may be a substantially flat piece of material configured to engage the connectors 312 (shown in FIGS. 1-2). In some embodiments, the bracket may be made of a rigid material, such as metal or plastic, and may be configured to at least partially support one or more of the plumbing outlet boxes. With reference to FIG. 1, in some embodiments, the bracket 322 is configured to be oriented with its larger width oriented vertically (e.g., in the configuration shown in FIG. 1) such that a longitudinal dimension of the bracket 322 may span the plumbing outlet boxes 305 and the larger width supports at least part of the weight of the boxes. In such embodiments, the bracket 322 may flex less in the plane of its larger width than in a plane of its smaller width (e.g., less vertical flex than front-to-back flex in the orientation of FIG. 1), such that the larger width may support the weight of the boxes. In some embodiments, the bracket may have at least one fold along its longitudinal axis to increase the rigidity of the bracket. In some other embodiments, the bracket may be substantially cylindrical, square, or another shape. In such embodiments, the connectors (e.g., the connectors 312 shown in FIG. 2) may be a corresponding shape to receive the brackets.

In some embodiments, the bracket 322 may support the one or more plumbing outlet boxes via tension in the longitudinal direction. In such embodiments, the bracket 322 may fixedly engage one or more connectors (e.g., the connectors 312 shown in FIG. 2) and apply a tension to the connector towards a stud (e.g., towards the center of the assembly 300 in FIG. 1). At least a portion of the weight of the one or more plumbing outlet boxes may then be supported by friction with the stud. For example, in the embodiment shown in FIG. 1, the brackets 322 may apply a tension on each of the plumbing outlet boxes 305 towards one another to press each box against a stud therebetween.

With continued reference to FIG. 3, the bracket 322 may include one or more fastening features 332 for engaging a wall and/or stud to position the one or more plumbing outlet boxes. The fastening features 332 may be built into the bracket 322, as shown in FIG. 3, or may alternatively be separate fastening features configured to engage the bracket and a wall and/or stud. Built in fastening features 332 may be formed from the bracket itself. For example, with reference to FIG. 3, the fastening feature may be a pointed fastening feature 336 that may be formed by cutting the pointed fastening feature from a section of the bracket. In some embodiments, the pointed fastening feature 336 may remain attached to the bracket 322 on at least one side, and may be separated from the bracket on the remaining sides to form a cutout 338. In such embodiments, the bracket may be attached to a wall or stud by pressing (e.g., with a hammer) the pointed fastening feature 336 into the wall or stud structure. In some alternative embodiments, the built in fastening feature may be a projection, spike, screw, or the like that may be attached or integrally formed with the bracket 322. In some embodiments, a plurality of built in or separate fastening features may be used. Some embodiments may include at least two fastening features facing opposite directions to simultaneously engage a wall and a stud.

As noted above, some embodiments of the bracket 322 may include one or more projections (e.g., the projections 450 shown in FIG. 5) for engaging one or more connectors (e.g., the connectors 312 shown in FIG. 2). The projections may be spaced in a predetermined orientation on the bracket 322 to fixedly engage one or more connectors. For example, referring back to FIG. 1, in some embodiments, the bracket 322 may be configured to fixedly engage at least one connector 312 on each plumbing outlet box 305. In some embodiments, the bracket 322 may fixedly engage the outermost (e.g., farthest from the center of the assembly 300) connectors 312 and slidingly engage the innermost (e.g., closest to the center of the assembly) connectors. In some alternative embodiments, the bracket 322 may fixedly engage the innermost connectors 312 and may slidingly engage the outermost connectors. Moreover, any other combination of fixed and sliding engagement between the brackets and the connectors may be used. In some embodiments, a fastener (e.g., screw, bolt, nail, clip, or the like) may engage one or more connectors 312 with the bracket 322 via receiving openings 334 in the bracket. The openings 334 may be positioned to fixedly engage the connectors as detailed above. In some embodiments, any number of openings 334 may be provided to receive fasteners to engage the connectors 312, a stud, and/or wall. In some further embodiments, evenly spaced openings 334 may be provided along the bracket 322 to allow the bracket to flexibly engage the plumbing outlet boxes, wall, and/or studs.

Turning to FIG. 4, a perspective view of an embodiment of a plumbing outlet box assembly 400 is shown having an I-shaped bracket 422. The plumbing outlet box assembly 400 may include substantially the same plumbing outlet boxes 305 as detailed above with respect to FIG. 1. In some further embodiments, as described below, various embodiments of the plumbing outlet boxes may be used with the one or more brackets detailed herein.

In the embodiment shown in FIG. 4, the bracket 422 engages the plumbing outlet boxes 305 via the connectors 312 to maintain the plumbing outlet box assembly 400 in a predetermined configuration and mount the assembly within a wall. The I-shaped bracket 422 may span vertically from the top wall 320 to the bottom wall 325 of either or both plumbing outlet boxes in order to engage at least one connector 312 on either side of the assembly 400.

In some embodiments, the bracket 422 may engage at least two connectors 312 on each plumbing outlet box 305. In such embodiments, the two connectors 312 may include at least one connector on the top wall 320 and at least one connector on the bottom wall 325 of a plumbing outlet box 305. In some further embodiments, the bracket 422 may engage at least two connectors 312 on the top wall 320 and/or at least two connectors on the bottom wall 325. In some embodiments, the bracket 422 may engage less than all of the connectors on a given wall (e.g., the top walls 320 or bottom walls 325 shown in FIG. 4). In such embodiments, the connectors 312 may still be disposed on their respective walls to maintain the rotational symmetry of the plumbing outlet box 305, as discussed above. Additionally or alternatively, a second I-shaped bracket 422 may be connected to a plumbing outlet box 305 proximate an opposite side wall, such that a third plumbing outlet box may be connected to the assembly 400.

The bracket 422 may engage the connectors 312 using one or more projections on either or both of the connector and the bracket as detailed above (e.g., with respect to the bracket 322 shown in FIG. 3). In some embodiments, the projections may engage the side surfaces of the connectors (e.g., the side surfaces 318 shown in FIG. 3).

Turning to FIG. 5, an I-shaped bracket 422 is shown in accordance with some embodiments of the present invention. As detailed above, the bracket 422 may engage one or more plumbing outlet boxes in a similar manner to other brackets (e.g., the bracket 322 shown in FIG. 3) described herein. The bracket 422 may include one or more engaging portions 440 at a top end 424 and a bottom end 426 configured to engage the connectors (e.g., the connectors 312 shown in FIG. 4).

The top end 424 and the bottom end 426 of the bracket 422 may be connected by a middle portion 442. In some embodiments, the middle portion 442 of the bracket 422 may be approximately the width of a stud at its widest point. With reference to FIG. 4, the middle portion of the bracket 422 may extend between the side walls 330, 335 of the plumbing outlet boxes 305.

Referring to FIGS. 4-5, in some embodiments, the middle portion 442 may include one or more recesses 454 for receiving the mounting tabs (e.g., the mounting tabs 352 shown in FIG. 4). In such embodiments, the mounting tabs 352 may directly abut the stud, and in some embodiments, the mounting tabs 352 and bracket 422 may be substantially coplanar. In some other embodiments, the bracket 422 may not include recesses 454 and/or the plumbing outlet boxes 305 may either not include mounting tabs 352 or the mounting tabs may overlap the bracket 422 such that one of the bracket or the mounting tabs may directly abut the stud while the other may abut the wall.

Similar to the linear bracket 322 detailed above, the I-shaped bracket 422 may include one or more receiving openings 452 for receiving a fastening device and/or one or more fastening features 432. As detailed above, the one or more fastening features 432 may be configured to engage a wall and/or stud to position the one or more plumbing outlet boxes. The fastening features 432 may be built into the bracket 422, as shown in FIG. 5, or may separately engage the bracket 422 and a wall and/or stud. Built in fastening features 432 may be formed from the bracket itself. For example, with reference to FIG. 3, the fastening feature may be a pointed fastening feature 436 that may be formed by cutting the pointed fastening feature from a section of the bracket. In some embodiments, the pointed fastening feature 436 may remain attached to the bracket 422 on at least one side, and may be separated from the bracket on the remaining sides to form a cutout 438. In such embodiments, the bracket may be attached to a wall or stud by pressing (e.g., with a hammer) the pointed fastening feature 436 into the wall or stud structure. In some alternative embodiments, the built in fastening feature may be a projection, spike, screw, or the like that may be attached or integrally formed with the bracket 422. In some embodiments, a plurality of built in or separate fastening features may be used. Some embodiments may include at least two fastening features facing opposite directions to simultaneously engage a wall and a stud. In some embodiments, the bracket 422 may include receiving openings 452 for receiving fastening devices therethrough. The fastening devices (not shown) may connect the bracket 422 to the stud, wall, and/or plumbing outlet boxes.

In some embodiments, the mounting tabs 352 may include mounting openings 354 for receiving a fastener therein. In some embodiments, the bracket 422 may have a corresponding opening for receiving a fastener when the mounting tab 352 and the bracket overlap. In some embodiments, as discussed in greater detail below, the mounting tabs may directly engage a receiving feature of another plumbing outlet box. In such embodiments, a fastener may simultaneously engage the bracket 422, the mounting tab and the receiving feature.

As detailed above, the bracket 422 may engage one or more points of contact (e.g., the connectors 312) on the plumbing outlet box 305. In some embodiment, the bracket 422 may engage at least two points of contact on each plumbing outlet box 305. For example, with reference to FIG. 4, the engaging portions 440 of the bracket 422 may engage the connectors 312 on the top wall 320 and/or bottom wall 325 of each plumbing outlet box 305. In some embodiments, any combination of connection points may be used to engage the bracket 422 with a plumbing outlet box 305. For example, a bracket may engage one connector 312 on each of the top 320 and bottom 325 walls as shown in FIG. 4. In some other embodiments, the bracket 422 may engage one of the connectors on either the top 320 or bottom 325 wall. The engaging portions 440 of the bracket may define a length that reaches only one of the connectors 312, or in yet some other embodiments, the engaging portions 440 may span the width of the plumbing outlet box 305 and may engage each of the connectors 312.

The bracket 422 may also be configured to connect the plumbing outlet box assembly 400 in any of a number of configurations. For example, each plumbing outlet box 305 may be connected at a connector 312 on the top 320 and bottom 325 surfaces as shown in FIG. 4. In some alternative embodiments, the bracket 422 may be linearly or diagonally connected to only one connector 312 on each plumbing outlet box. In some further embodiments multiple connectors 312 on one or more of the walls of the plumbing outlet boxes may be used.

The engaging portions 440 of the bracket 422 may be configured to engage the plumbing outlet boxes 305 via projections or receiving openings that engage the connectors. For example, with reference to FIG. 5, the engaging portion 440 may include a projection 450 that forms a lip along the surface of the bracket 422. The projection 450 may be configured to engage a side surface of the connectors (e.g., the side surface 318 of the connector 312 shown in FIG. 2). In some alternative embodiments, the projections may be disposed on the connectors 312 and may be received by openings in the bracket.

As detailed above with respect to the linear bracket 322, the bracket 422 may be inserted into a channel 316 defined by the connector 312 in order to engage the plumbing outlet box 305. Also as detailed above, the bracket and connectors may take any shape that enables the bracket to be slidingly or fixedly engaged with the plumbing outlet box. In the configurations detailed above, the bracket may fixedly engage a subset of the connectors and slidingly engage the remaining connectors. For example, when multiple connectors on a single wall are engaged, only one or both may be fixedly engaged with the bracket. Alternatively, only one or multiple connectors on a plumbing outlet box may be fixedly engaged with the bracket, with the remaining connectors being slidingly engaged.

In the embodiment shown in FIG. 5, the bracket 422 includes projections 450 that stand out from the surface of the bracket to engage an edge of the connector (e.g., the edge or side surface 318 shown in FIG. 2). The projection 450 may be formed as a bump or protrusion from the surface of the bracket 450 or alternatively may be formed as an angled ramp for directionally engaging the connector. For example, in the embodiment shown in FIG. 5, the projection 450 forms a raised lip that may deflect inwardly as the bracket 422 is inserted into the channel (e.g., the channel 316 shown in FIG. 2). In such an embodiment, each projection 450 may restrict movement of the bracket relative to the plumbing outlet box 305 in a single direction. In some embodiments the structure of the bracket (e.g., the middle portion 442) may contact the plumbing outlet box 305 to restrict the other direction. In some embodiments the projection 450 may be formed by linearly cutting partially through the vertical length of the engaging portion 440 and folding the projection 450 out of the plane of the bracket 422. In some other embodiments, the projection may be formed in any direction to engage a desired surface of the plumbing outlet box. In yet some further embodiments, multiple cuts in the bracket may form a complex projection. In some embodiments, the bracket may be cut in the center of the bracket 422 to form a raised projection that is vertically proximate the center of the engaging portion 440. Alternatively, as detailed above, the bracket 422 may include a receiving opening or edge for engaging a similar projection on the plumbing outlet box. As detailed above with respect to the linear bracket 322, the projection may be any type of bump, buckle, clip, clamp, raised portion, or other engaging feature, or a corresponding receiving surface therefore, that may enable the bracket to engage a plumbing outlet box.

In the embodiments detailed herein, the brackets 322, 422 may be used to connect any number plumbing outlet boxes to a wall, stud, or studs. For example, the brackets 322, 422, either alone or in combination with the mounting tabs (e.g., the mounting tabs 352 shown in FIG. 1) may fasten to a stud and/or wall as detailed herein. The brackets 322, 422 may retain the plumbing outlet box with or without an additional plumbing outlet box connected to an opposite side of the bracket. In some further embodiments, additional brackets 322, 422 or longer versions of a single bracket may be configured to connect three or more plumbing outlet boxes into a single assembly. In some embodiments the brackets 322, 422 may span two or more studs to support one or more plumbing outlet boxes therebetween.

Additional reference will be made to several embodiments of the plumbing outlet boxes that are also described in U.S. patent application Ser. No. 14/536,222, entitled "Plumbing Outlet Box with Integrated Mounting Features" and filed Nov. 7, 2014, and U.S. patent application Ser. No. 14/154,949, entitled "Plumbing Outlet Box With Integrated Mounting Features" and filed Jan. 14, 2014, which references are both incorporated by reference herein in their entireties. In each of the embodiments of plumbing outlet boxes discussed herein, any of the brackets 322, 422 may be used alone or in combination with other brackets and features to attach one or more plumbing outlet boxes to a wall or one or more studs within a wall.

Turning to FIG. 6, an embodiment of a plumbing outlet box 5 is shown that is configured to be mounted within a wall (not shown). The plumbing outlet box 5 may comprise a housing 10 that includes a top wall 20, a bottom wall 25, a first side wall 30, and a second side wall 35. The housing 10 may define an opening 40 that provides access to an interior 45 of the housing. The plumbing outlet box 5 may be configured to receive one or more brackets 322, 422 as detailed above.

With continued reference to FIG. 6, the plumbing outlet box 5 may further include a first receiving feature 50 extending outwardly from the first side wall 30 and a second receiving feature 55 extending outwardly from the second side wall 35. Similarly, a first mounting tab 60 may extend outwardly from the first side wall 30, and a second mounting tab 65 may extend outwardly from the second side wall 35. The receiving features 50, 55 and the mounting tabs 60, 65 may be integral with the housing (e.g., integrally molded from the same plastic material, such as polyvinyl chloride (PVC)) in some cases.

Receiving features 50, 55 of one plumbing outlet box may be configured to receive and engage with mounting tabs 60, 65 of another plumbing outlet box, such that two plumbing outlet boxes may be attached to each other in a side-by-side manner (e.g., as shown in FIG. 7 and described in greater detail below) by connecting a receiving feature and a mounting tab extending from one side of one of the plumbing outlet boxes with a corresponding mounting tab and receiving feature extending from a corresponding side of the other plumbing outlet box.

As such, each receiving feature 50, 55 (shown in FIG. 6) may be configured to receive a mounting tab of another plumbing outlet box (e.g., where the mounting tab of the other plumbing outlet box is configured as shown and described herein with respect to the first and second mounting tabs 60, 65). Likewise each mounting tab 60, 65 may be configured to be received by a receiving feature of another plumbing outlet box (e.g., where the receiving feature of the other plumbing outlet box is configured as shown and described herein with respect to the first and second receiving features 50, 55). The engagement of receiving features with mounting tabs is described in greater detail below. For ease of explanation, the mounting tabs and receiving features of the other plumbing outlet boxes are referenced herein as "engaging" mounting tabs and "engaging" receiving features.

As illustrated in FIG. 6, the first receiving feature 50 may be located proximate the top wall 20 and the second receiving feature 55 may be located proximate the bottom wall 25, while the first mounting tab 60 may be located proximate the bottom wall 25 and the second mounting tab 65 may be located proximate the top wall 20. Said differently, the first and second receiving features 50, 55 may be disposed near one pair of opposite corners of the plumbing outlet box 5 with respect to each other. Likewise, the first and second mounting tabs 60, 65 may be disposed near the other pair of opposite corners of the plumbing outlet box 5 with respect to each other. Similar to the embodiments detailed above, the plumbing outlet box 5 may further include a connector 312 for engaging a bracket (e.g., the brackets 322 or 422 detailed above).

Thus, considering only the placement of the receiving features 50, 55 and the mounting tabs 60, 65 about the perimeter of the opening 40, the receiving features and mounting tabs are placed so as to impart rotational symmetry to the plumbing outlet box 5, as detailed above. As a result of this rotational symmetry (e.g., 2-fold rotational symmetry as shown), a rotation of 180° of the view shown in FIG. 6 results in the same relative position of the receiving features and mounting tabs. Thus, as described in greater detail herein, an assembly of outlet boxes may be placed in side-by-side fashion and engaged via engagement of the corresponding receiving features 50, 55 and mounting tabs 60, 65, regardless of whether the top wall 20 of the housing is facing up (as shown in FIG. 6) or facing down (e.g., rotated 180° from the view shown in FIG. 6).

Turning now to FIG. 7, embodiments of the plumbing outlet box 5 (e.g., shown in FIG. 6) as described above may be attached to each other via corresponding receiving features 50, 55 and mounting tabs 60, 65 to form an assembly 80 of plumbing outlet boxes 5, 5'. In this regard, the assembly 80 may include at least a first plumbing outlet box 5 and a second plumbing outlet box 5', each configured for mounting within a wall, and each configured as described above with respect to FIG. 6. Each plumbing outlet box 5, 5' may thus comprise a housing including a top wall, a bottom wall, first and second side walls, and an opening providing access into an interior of the housing. A first receiving feature may extend outwardly from the first side wall; a second receiving feature may extend outwardly from the second side wall; a first mounting tab may extend outwardly from the first side wall; and a second mounting tab may extend outwardly from the second side wall. As described above with respect to FIG. 6, the first receiving feature may be located proximate the top wall and the second receiving feature may be located proximate the bottom wall. Similarly, the first mounting tab may be located proximate the bottom wall and the second mounting tab may be located proximate the top wall.

With reference to FIG. 7, the housing 10' of the second plumbing outlet box 5' may be configured to be engaged with the housing 10 of the first plumbing outlet box 5 via engagement of one of the first or second mounting tabs 60', 65' of the second plumbing outlet box housing 10' with a corresponding one of the first or second receiving features 50, 55 of the first plumbing outlet box housing 10 and engagement of one of the first or second receiving features 50', 55' of the second plumbing outlet box housing 10' with a corresponding one of the first or second mounting tabs 60, 65 of the first plumbing outlet box housing 10. In the example illustrated in FIG. 7, for example, the first receiving feature 50 of the first plumbing outlet box housing 10 is engaged with the second mounting tab 65' of the second plumbing outlet box housing 10', and the first mounting tab 60 of the first plumbing outlet box housing 10 is engaged with the second receiving feature 55' of the second plumbing outlet box housing 10'. Moreover, due to the rotational symmetry of the placement of the respective receiving features and mounting tabs, the first and second plumbing outlet box housings 10, 10' may be configured to be engaged to each other regardless of the relative orientation of the two plumbing outlet box housings. In other words, in some embodiments, one or both of the plumbing outlet boxes 5, 5' shown in FIG. 7 may be rotated by 180° from the orientation shown (and/or from the orientation of the other of the two plumbing outlet boxes) while still maintaining the ability to be attached to each other as described above.

In this regard, in some cases, the first and second plumbing outlet box housings 10, 10' may be identical (e.g., have identical configurations). For the purposes of the description herein, the term "identical" does not preclude the existence of a certain imperfections and differences within an acceptable degree of manufacturing tolerance as understood in the art. Rather, the configuration of each plumbing outlet box 5, 5' may be such that the size, number, position, function, etc. of the connections and openings for making such connections are the same.

Accordingly, a single configuration of a plumbing outlet box (such as the configuration of the plumbing outlet box 5 shown in FIG. 6, for example) may be used as a "universal" plumbing outlet box, with some or all of the available connections being used as desired to accommodate the particular installation scenario and with the particular orientation of the plumbing outlet box selected to optimize the use of the connections. Referring again to FIG. 6, for example, the plumbing outlet box 5 may be configured such that the top wall 20 and the bottom wall 25 each includes drain openings 85, 90. The top drain opening 85 may, for example, have a diameter of 1½ inches, whereas the bottom drain opening 90 may, for example have a diameter of 2 inches. In other embodiments, however, the drain openings 85, 90 may be the same size as each other or different sizes, and the sizes may be larger or smaller than those described herein to accommodate different consumer requirements and usage scenarios. In still other embodiments, at least one of the top wall and the bottom wall may also include a pair of laterally-spaced openings 92, 94 configured to accommodate hot and cold water supply connections, such as to allow the plumbing outlet box 5 to be used in a washing machine installation.

As noted above, due to the rotational symmetry of the placement of the receiving features and mounting tabs, the plumbing outlet box 5 may be orientated as shown in FIG. 6 or in an orientation that is rotated by 180° from the orientation shown in FIG. 6. In some embodiments, the two laterally-spaced openings 92, 94 may be used to accommodate hot and cold water supply connections, and the drain opening 90 may be used to receive effluent (e.g., from a washing machine).

Accordingly, as described above, a method of installing a plumbing outlet box assembly comprising at least two plumbing outlet boxes within a wall is described that includes providing first and second plumbing outlet boxes. Each plumbing outlet box may have a housing that includes a top wall, a bottom wall, first and second side walls, and an opening providing access into an interior of the housing. As described above with respect to the figures, a first receiving feature may extend outwardly from the first side wall; a second receiving feature may extend outwardly from the second side wall; a first mounting tab may extend outwardly from the first side wall; and a second mounting tab may extend outwardly from the second side wall. The first receiving feature may be located proximate the top wall and the second receiving feature may be located proximate the bottom wall. Likewise, the first mounting tab may be located proximate the bottom wall, and the second mounting tab may be located proximate the top wall.

In some embodiments, the second plumbing outlet box housing may be engaged to the first plumbing outlet box housing via engagement of one of the first or second mounting tabs of the second plumbing outlet box housing with a corresponding one of the first or second receiving features of the first plumbing outlet box housing and engagement of one of the first or second receiving features of the second plumbing outlet box housing with a corresponding one of the first or second mounting tabs of the first plumbing outlet box housing. Additionally or alternatively, as detailed herein, the first and second plumbing outlet boxes may be connected via one or more brackets. The first plumbing outlet box housing may be fastened within the cutout, as described above, and the second plumbing outlet box housing may also be fastened within the cutout.

Moreover, the first plumbing outlet box and the second plumbing outlet box may be fastened within the cutout by inserting a fastener through an opening on the respective receiving feature, as described above. For example, each receiving feature of the first and second plumbing outlet boxes may comprise a pair of lateral receiving arms and a main receiving arm disposed therebetween. Fastening the first plumbing outlet box within the cutout may comprise inserting a fastener through an opening in the respective lateral receiving arms of the first plumbing outlet box and inserting a fastener through an opening in the main receiving arm of the first plumbing outlet box following engagement of the second plumbing outlet box housing to the first plumbing outlet box housing. Fastening the second plumbing outlet box within the cutout may comprise inserting a fastener through a slot in the mounting tab of the second plumbing outlet box and the opening in the corresponding main receiving arm of the first plumbing outlet box following engagement of the second plumbing outlet box housing to the first plumbing outlet box housing. In other embodiments, however, at least some of the fasteners may be applied to the first plumbing outlet box prior to engaging the second plumbing outlet box housing to the first plumbing outlet box housing.

FIG. 8 shows an embodiment of the present invention having an alternative embodiment of at least the mounting tabs and receiving features. In the embodiment shown in FIG. 8, a plumbing outlet box 105 is shown that is configured to be mounted within a wall (not shown). The plumbing outlet box 105 may comprise a housing 110 including a top wall 120, bottom wall 125, first side wall 130, and second side wall 135. The housing 110 may define an opening 140 that provides access to an interior 145 of the housing. Similar to the embodiments detailed above, the plumbing outlet box 105 may further include a connector 312 for engaging a bracket (e.g., the brackets 322 or 422 detailed above).

With continued reference to FIG. 8, the plumbing outlet box 105 may include a first receiving feature 150 disposed on the first side wall 130 and a second receiving feature 155 disposed on the second side wall 135. Similarly, a first mounting tab 160 may extend outwardly from the first side wall 130, and a second mounting tab 165 may extend outwardly from the second side wall 135. The receiving features 150, 155 and the mounting tabs 160, 165 may be integral with the housing (e.g., integrally molded from the same plastic material, such as polyvinyl chloride (PVC)) in some cases, as described herein.

Receiving features 150, 155 of one plumbing outlet box may be configured to receive and engage with mounting tabs of another plumbing outlet box, such that two plumbing outlet boxes may be attached to each other in a side-by-side manner (e.g., as shown in FIG. 9 and described in greater detail herein) by connecting a receiving feature and a mounting tab extending from one side of one of the plumbing outlet boxes with a corresponding mounting tab and receiving feature extending from a corresponding side of the other plumbing outlet box.

Accordingly, each receiving feature 150, 155 may be configured to receive a mounting tab of another plumbing outlet box (e.g., where the mounting tab of the other plumbing outlet box is configured as shown and described herein with respect to the first and second mounting tabs 160, 165) Likewise each mounting tab 160, 165 may be configured to be received by a receiving feature of another plumbing outlet box (e.g., where the receiving feature of the other plumbing outlet box is configured as shown and described herein with respect to the first and second receiving features 150, 155). The engagement of receiving features with mounting tabs is described in greater detail herein. As noted above, for ease of explanation, the mounting tabs and receiving features of the other plumbing outlet boxes are referenced herein as "engaging" mounting tabs and "engaging" receiving features. These "engaging" features may include substantially the same structure as their counterparts described herein.

As illustrated in FIG. 8, the first receiving feature 150 may be located proximate the bottom wall 125 and the second receiving feature 155 may be located proximate the top wall 120, while the first mounting tab 160 may be located proximate the top wall 120 and the second mounting tab 165 may be located proximate the bottom wall 125. Said differently, the first and second receiving features 150, 155 may be disposed near one pair of opposite corners of the plumbing outlet box 105 with respect to each other. Likewise, the first and second mounting tabs 160, 165 may be disposed near the other pair of opposite corners of the plumbing outlet box 105 with respect to each other.

Turning now to FIG. 9, as with the embodiments described with respect to FIG. 6, some embodiments of the plumbing outlet box 105 (e.g., shown in FIG. 8) as described above may be attached to each other via corresponding receiving features 150, 155 and mounting tabs 160, 165 to form an assembly 180 of plumbing outlet boxes 105, 105'. In this regard, the assembly 180 may include at least a first plumbing outlet box 105 and a second plumbing outlet box 105', each configured for mounting within a wall, and each configured as described above with respect to FIG. 8. Each plumbing outlet box 105, 105' may thus comprise a housing including a top wall, a bottom wall, first and second side walls, and an opening providing access into an interior of the housing. A first receiving feature may be disposed on the first side wall; a second receiving feature may be disposed on the second side wall; a first mounting tab may extend outwardly from the first side wall; and a second mounting tab may extend outwardly from the second side wall. As described above with respect to FIG. 8, the first receiving feature may be located proximate the bottom wall and the second receiving feature may be located proximate the top wall. Similarly, the first mounting tab may be located proximate the top wall and the second mounting tab may be located proximate the bottom wall.

With reference to FIG. 9, the housing 110' of the second plumbing outlet box 105' may engage the housing 110 of the first plumbing outlet box 105 via engagement of one of the first or second mounting tabs 160', 165' of the second plumbing outlet box housing 110' with a corresponding one of the first or second receiving features 150, 155 of the first plumbing outlet box housing 110 and engagement of one of the first or second receiving features 150', 155' of the second plumbing outlet box housing 110' with a corresponding one of the first or second mounting tabs 160, 165 of the first plumbing outlet box housing 110. In the example embodiment of FIG. 9, for example, the first receiving feature 150 of the first plumbing outlet box housing 110 may be engaged with the second mounting tab 165' of the second plumbing outlet box housing 110', and the first mounting tab 160 of the first plumbing outlet box housing 110 may be engaged with the second receiving feature 155' (not shown) of the second plumbing outlet box housing 110'. Moreover, due to the rotational symmetry of the placement of the respective receiving features and mounting tabs, the first and second plumbing outlet box housings 110, 110' may be configured to be engaged to each other regardless of the relative orientation of the two plumbing outlet box housings. In other words, in some embodiments, one or both of the plumbing outlet boxes 105, 105' shown in FIG. 9 may be rotated by 180° from the orientation shown (and/or from the orientation of the other of the two plumbing outlet boxes) while still maintaining the ability to be attached to each other as described above.

In this regard, in some cases, the first and second plumbing outlet box housings 110, 110' may be identical (e.g., have identical configurations). For the purposes of the description herein, the term "identical" does not preclude the existence of a certain imperfections and differences within an acceptable degree of manufacturing tolerance as understood in the art. Rather, the configuration of each plumbing outlet box 105, 105' may be such that the size, number, position, function, etc. of the connections and openings for making such connections are the same.

In addition, many other modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. By way of example, any features of any embodiment described herein may be wholly or partially incorporated or combined into various other embodiments. Although specific terms are employed herein, they are used in a generic and descriptive sense only and not for purposes of limitation. Moreover, steps in the methods described above may occur in any order and are not limited to the order described above.

What is claimed is:

1. An assembly of plumbing outlet boxes comprising:

at least a first plumbing outlet box and a second plumbing outlet box each configured for mounting within a wall, and each comprising:

a housing including a top wall, a bottom wall, first and second side walls, and an opening providing access into an interior of the housing, and wherein a first connector is disposed on the top wall, wherein a second connector is disposed on the bottom wall, and a bracket defining a plurality of engaging portions, wherein the bracket is a single piece I-shaped bracket having respective first engagement portions located at a top end and respective second engagement portions located at a bottom end;

wherein the second plumbing outlet box housing is configured to be engaged with the first plumbing outlet box housing via the bracket, wherein one of the respective first engaging portions of the bracket is in engagement with the first connector of the first plumbing outlet box and the other respective first engaging portion of the bracket is in engagement with the first connector of the second plumbing outlet box, and one of the respective second engaging portions of the bracket is in engagement with the second connector of the first plumbing outlet box and the other respective second engaging portion of the bracket is in engagement with the second connector of the second plumbing outlet box.

2. The assembly of claim 1, wherein the bracket is further configured to engage an additional connector of the first plumbing outlet box and an additional connector of the second plumbing outlet box.

3. The assembly of claim 1, wherein the bracket is configured to engage a stud such that the bracket is configured to attach the first plumbing outlet box and the second plumbing outlet box to the stud.

4. The assembly of claim 3, wherein the bracket further includes a built-in fastening feature, such that the bracket is configured to engage the stud with the built-in fastening feature.

5. The assembly of claim 1, wherein at least one of the first connector and the second connector of at least one of the plumbing outlet boxes defines a receiving channel configured to receive a corresponding one of the first engaging portion or the second engaging portion of the bracket.

6. The assembly of claim 5, wherein the at least one of the first connector and the second connector defines a plurality of offset tabs defining the receiving channel therebetween.

7. The assembly of claim 5, wherein the bracket defines a projection on the corresponding one of the first engaging portion or the second engaging portion configured to engage the at least one of the first connector and the second connector.

8. The assembly of claim 1, wherein at least one of the first plumbing outlet box and the second plumbing outlet box defines one or more mounting tabs configured to engage the at least one of the first plumbing outlet box and the second plumbing outlet box to a stud.

9. A bracket for mounting a plumbing outlet box within a wall the bracket comprising:

a single piece I-shape having a plurality of engaging portions;

wherein respective first engaging portions are disposed on a top end of the bracket;

wherein respective second engaging portions are disposed on a bottom end of the bracket; and wherein one of the respective first engaging portions of the bracket is configured to engage a first connector of a first plumbing outlet box and the other respective first engaging portion of the bracket is configured to engage a first connector of a second plumbing outlet box, and wherein one of the respective second engaging portions of the bracket is configured to engage a second connector of the first plumbing outlet box and the other respective second engaging portion of the bracket is configured to engage a second connector of the second plumbing outlet box.

10. The bracket of claim 9, wherein the bracket is configured to engage a stud such that the bracket is configured to attach the first plumbing outlet box and the second plumbing outlet box to the stud.

11. The bracket of claim 10, wherein the bracket further includes a built-in fastening feature, such that the bracket is configured to engage the stud with the built-in fastening feature.

12. The bracket of claim 11, wherein the built-in fastening feature comprises a pointed fastening feature integrally formed with the bracket.

13. The bracket of claim 9, wherein the bracket defines a projection on at least one of the first engaging portions or the second engaging portions.

14. The bracket of claim 9, wherein the bracket is further configured to engage an additional connector of the first plumbing outlet box and an additional connector of the second plumbing outlet box.

* * * * *